US011846298B2

(12) United States Patent
Suzuki et al.

(10) Patent No.: US 11,846,298 B2
(45) Date of Patent: Dec. 19, 2023

(54) VACUUM PUMP AND VACUUM PUMP COMPONENT PART

(71) Applicant: Edwards Japan Limited, Chiba (JP)

(72) Inventors: Haruki Suzuki, Chiba (JP); Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 17/796,785

(22) PCT Filed: Jan. 29, 2021

(86) PCT No.: PCT/JP2021/003412
§ 371 (c)(1),
(2) Date: Aug. 1, 2022

(87) PCT Pub. No.: WO2021/157497
PCT Pub. Date: Aug. 12, 2021

(65) Prior Publication Data

US 2023/0053298 A1 Feb. 16, 2023

(30) Foreign Application Priority Data

Feb. 7, 2020 (JP) ..... 2020-019630

(51) Int. Cl.
*F04D 19/04* (2006.01)
*F04D 29/32* (2006.01)
(Continued)

(52) U.S. Cl.
CPC ..... *F04D 29/324* (2013.01); *F04D 17/168* (2013.01); *F04D 19/042* (2013.01); *F04D 29/544* (2013.01)

(58) Field of Classification Search
CPC ..... F04D 17/168; F04D 19/04; F04D 19/042; F04D 19/044; F04D 19/046;
(Continued)

(56) References Cited

U.S. PATENT DOCUMENTS 6,343,910 B1 * 2/2002 Kawasaki ..... F04D 19/044 415/199.5
6,382,249 B1 * 5/2002 Kawasaki ..... C23C 16/4412 137/565.33

(Continued)

FOREIGN PATENT DOCUMENTS

JP 6228839 B2 11/2017
JP 6353195 B2 7/2018
JP 6616560 B2 12/2019

OTHER PUBLICATIONS

PCT International Search Report dated Apr. 6, 2021 for corresponding PCT application Serial No. PCT/JP2021/003412, 2 pages.

(Continued)

*Primary Examiner* — Woody A Lee, Jr.
*Assistant Examiner* — Behnoush Haghighian
(74) *Attorney, Agent, or Firm* — Theodore M. Magee; Westman, Champlin & Koehler, P.A.

(57) ABSTRACT

Provided is a vacuum pump regarding which compression can be improved at low costs.

Included is a plurality of Siegbahn exhaust mechanisms in which a helical groove is provided to a stator disc. The Siegbahn exhaust mechanisms are provided on both faces of an upstream side and a downstream side of the stator disc. An end portion of the helical groove provided on the upstream side and a start portion of the helical groove provided on the downstream side are situated at least partially overlapping in a circumferential direction. A width of a channel of a switchback portion of the upstream side and the downstream side is equivalent or less than a depth of a channel of the Siegbahn exhaust mechanisms.

4 Claims, 6 Drawing Sheets

(51) Int. Cl.
*F04D 29/54* (2006.01)
*F04D 17/16* (2006.01)

(58) Field of Classification Search
CPC .... F04D 19/048; F04D 29/522; F04D 29/544; F04D 29/441; F04D 29/444; F04D 29/30
See application file for complete search history.

(56) References Cited

U.S. PATENT DOCUMENTS 6,409,468 B1 * 6/2002 Kawasaki ..... F04D 29/023 415/72
6,585,480 B2 * 7/2003 Kawasaki ..... F04D 19/046 415/90
8,070,419 B2 * 12/2011 Helmer ..... F04D 17/168 415/90
8,152,442 B2 * 4/2012 Helmer ..... F04D 17/168 415/55.1
9,309,892 B2 * 4/2016 Tollner ..... F04D 19/044
9,702,374 B2 * 7/2017 Emelli ..... F04D 17/02
10,267,321 B2 * 4/2019 Nonaka ..... F04D 17/168
10,280,937 B2 * 5/2019 Nonaka ..... F04D 17/168
10,662,957 B2 * 5/2020 Nonaka ..... F04D 17/168
10,823,200 B2 * 11/2020 Sakaguchi ..... F04D 19/04
10,968,915 B2 * 4/2021 Giors ..... F04D 19/042
2010/0158667 A1 * 6/2010 Helmer ..... F04D 17/168 415/97
2013/0045094 A1 * 2/2013 Giors ..... F04D 29/023 415/200
2016/0069350 A1 * 3/2016 Nonaka ..... F04D 17/168 415/115
2016/0298645 A1 * 10/2016 Nonaka ..... F04D 17/122
2016/0319825 A1 * 11/2016 Nonaka ..... F04D 29/384

OTHER PUBLICATIONS

PCT International Written Opinion dated Apr. 6, 2021 for corresponding PCT application Serial No. PCT/JP2021/003412, 4 pages.

* cited by examiner

FIG. 3(a) A－A

VACUUM PUMP AND VACUUM PUMP COMPONENT PART

CROSS-REFERENCE OF RELATED APPLICATION

This application is a Section 371 National Stage Application of International Application No. PCT/JP2021/003412, filed Jan. 29, 2021, which is incorporated by reference in its entirety and published as WO 2021/157497A1 on Aug. 12, 2021 and which claims priority of Japanese Application No. 2020-019630, filed Feb. 7, 2020.

BACKGROUND

The present invention relates to a vacuum pump such as a turbomolecular pump, for example, and to a component part of the same.

There is commonly known a turbomolecular pump, as a type of vacuum pump. This turbomolecular pump is configured to rotate rotor blades by electricity being applied to a motor within a pump main unit, and to exhaust gas by bouncing away gas molecules of gas (process gas) sucked into the pump main unit.

One type of such a turbomolecular pump is called a "Siegbahn" type (Japanese Patent Nos. 6228839, 6353195, and 6616560). This Siegbahn type molecular pump has a plurality of helical groove channels formed, partitioned by ridge portions, in a gap between a rotor disc and a stator disc. In the Siegbahn type molecular pump, gas molecules dispersed throughout the helical groove channels are imparted with tangential-direction kinetic momentum by the rotor disc, giving an advantageous directionality toward an exhaust direction by the helical groove channels, and thus performing exhaust.

The discussion above is merely provided for general background information and is not intended to be used as an aid in determining the scope of the claimed subject matter. The claimed subject matter is not limited to implementations that solve any or all disadvantages noted in the background.

SUMMARY

Now in a vacuum pump such as the above-described Siegbahn type molecular pump, a compression ratio tends to be insufficient if there is only a single stage of a set of the rotor disc and the stator disc, and may be industrially unusable. Accordingly, multiple stages of sets of the rotor disc and the stator disc are used, to improve the compression ratio. However, if a flow within the helical groove channels of a prior stage is not appropriately connected to a flow within the helical groove channels of a next stage (following stage), the kinetic momentum of the gas molecules will be lost, and compression cannot be performed well.

Accordingly, conventionally, the flow in the prior stage and the flow in the following stage have been connected by providing protruding portions (denoted by sign 600, etc., in Japanese Patent No. 6616560) or communicating holes (denoted by sign 501, etc., in Japanese Patent No. 6353195) between the helical groove channels of the prior stage and the helical groove channels of the following stage, thereby preventing loss of kinetic momentum relating to gas molecules, as disclosed in Japanese Patent Nos. 6228839, 6353195, and 6616560. Accordingly, shapes of rotor discs and stator discs have become complicated, necessitating costs for machining the protruding portions and the communicating holes. An object of the present invention is to provide a vacuum pump and a vacuum pump component part capable of improving compression at low costs.

(1) In order to achieve the above object, an aspect of the present invention is a vacuum pump, including: a plurality of Siegbahn exhaust mechanisms in which a helical groove is provided to at least one of a rotor disc and a stator disc, at least part of the Siegbahn exhaust mechanisms being provided on both faces of an upstream side and a downstream side of the rotor disc or the stator disc. An end portion of the helical groove provided on the upstream side and a start portion of the helical groove provided on the downstream side are situated at least partially overlapping in a circumferential direction, and a width of a channel of a switchback portion of the upstream side and the downstream side is equivalent or less than a depth of a channel of the Siegbahn exhaust mechanisms.

(2) Also, in order to achieve the above object, in the vacuum pump according to the above (1), a side portion of the helical groove at the end portion and a side portion of the helical groove at the start portion may be at least partially situated on a same straight line.

(3) Also, in order to achieve the above object, in the vacuum pump according to the above (1) or (2), the switchback portion may be formed on at least one of an outer circumferential side of the rotor disc and an inner circumferential side of the stator disc.

(4) Also, in order to achieve the above object, another aspect of the present invention is a vacuum pump component part used in a vacuum pump that includes a plurality of Siegbahn exhaust mechanisms in which a helical groove is provided to at least one of a rotor disc and a stator disc, at least part of the Siegbahn exhaust mechanisms being provided on both faces of an upstream side and a downstream side of the rotor disc or the stator disc. An end portion of the helical groove provided on the upstream side and a start portion of the helical groove provided on the downstream side are situated at least partially overlapping in a circumferential direction, and a width of a channel of a switchback portion of the upstream side and the downstream side is equivalent or less than a depth of a channel of the Siegbahn exhaust mechanisms.

(5) Also, in order to achieve the above object, in the vacuum pump component part according to the above (4), a side portion of the helical groove at the end portion and a side portion of the helical groove at the start portion may be at least partially situated on a same straight line.

(6) Also, in order to achieve the above object, in the vacuum pump component part according to the above (4) or (5), the switchback portion may be formed on at least one of an inner circumferential side and an outer circumferential side of at least one of the rotor disc and the stator disc.

According to the above invention, a vacuum pump and a vacuum pump component part capable of improving compression at low costs can be provided.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIG. 3A is an explanatory diagram schematically illustrating an upstream side of a stator disc at portion indicated by line A-A in FIG. 1;

DETAILED DESCRIPTION

Figure 1:
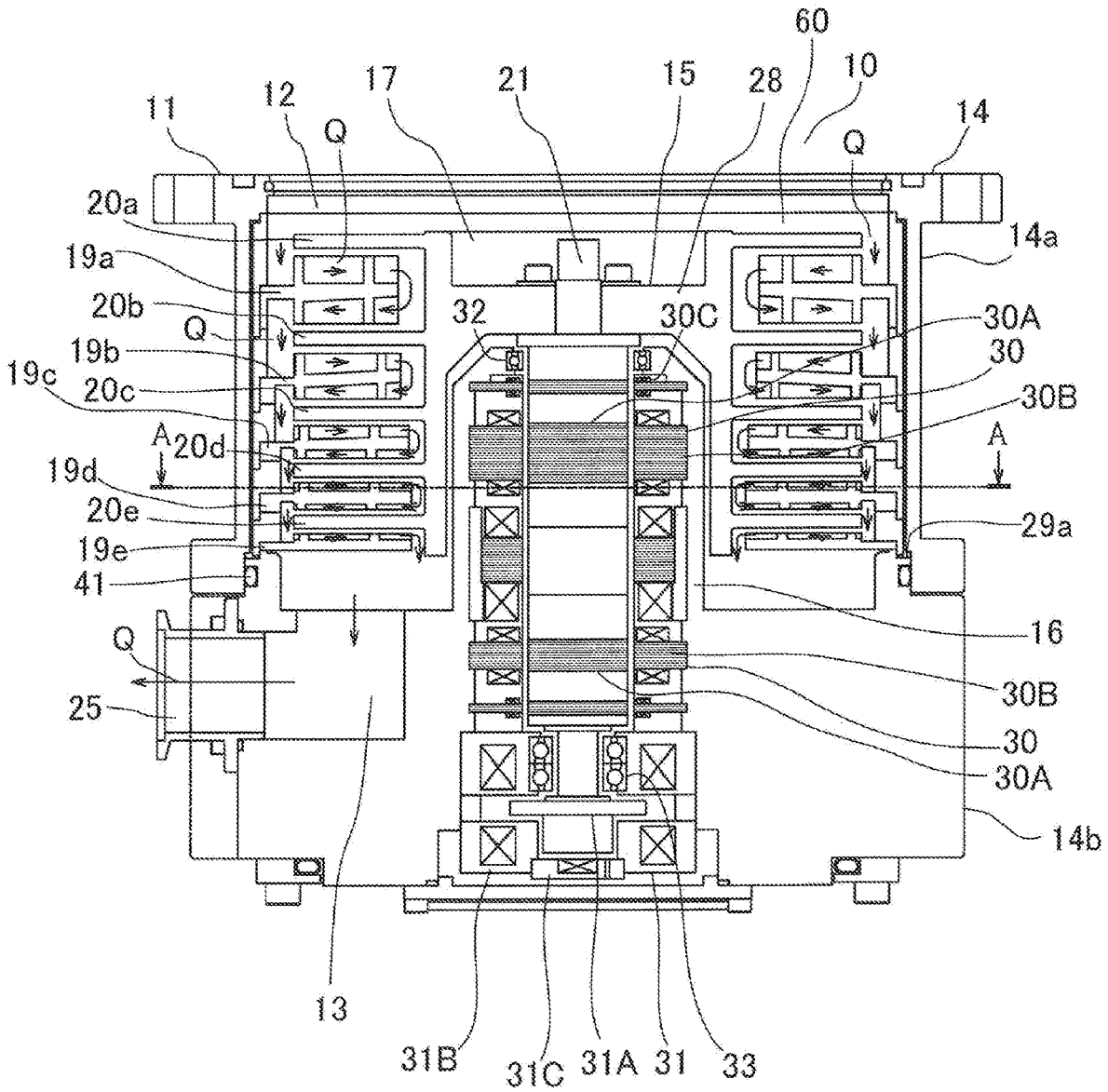
FIG. 1 is a longitudinal-sectional view of a turbomolecular pump according to an embodiment of the present invention.

A vacuum pump according to an embodiment of the present invention will be described below with reference to the Figures. FIG. 1 schematically illustrates a longitudinal sectional view taken of a Siegbahn type turbomolecular pump (hereinafter referred to as "turbomolecular pump") 10 as the vacuum pump according to the embodiment of the present invention. This turbomolecular pump 10 is arranged to be connected to a vacuum chamber (omitted from illustration) of object equipment such as a semiconductor manufacturing device or the like, for example.

The turbomolecular pump 10 integrally includes a pump main unit 11 that is cylindrical in shape, and an electrical component case (omitted from illustration) that is box-like in shape. Of these, the pump main unit 11 is arranged such that an upper side in FIG. 1 is an inlet portion 12 connected to an object equipment side, and a lower side is an outlet portion 13 connected to an auxiliary pump (back pump) or the like. In addition to a vertical-direction orientation in the gravitational direction, such as illustrated in FIG. 1, the turbomolecular pump 10 is also capable of being used in a vertically inverted orientation, a horizontal orientation, and an inclined orientation, as well.

The electrical component case (omitted from illustration) accommodates a power source circuit unit for supplying electric power to the pump main unit 11, and a control circuit unit for controlling the pump main unit 11, although these are omitted from illustration. The control circuit unit performs controls of various types of equipment, such as a later-described motor 16, magnetic bearings (omitted from illustration), a heater 48, and so forth.

The pump main unit 11 includes a main unit casing 14 serving as a housing that is substantially cylindrical in shape. The main unit casing 14 is made up of an intake side casing 14*a* serving as an intake side part situated at an upper portion in FIG. 1, and an outlet side casing 14*b* serving as an outlet side part situated at a lower portion in FIG. 1, which are serially connected in an axial direction. Now, the intake side casing 14*a* may be referred to as "casing" or the like, for example, and the outlet side casing 14*b* may be referred to as "base" or the like, for example.

The intake side casing 14*a* and the outlet side casing 14*b* overlap each other in a radial direction (right-left direction in FIG. 1). Further, an inner circumferential face of the intake side casing 14*a* at one end portion in the axial direction (a lower end portion in FIG. 1) faces an outer circumferential face of an upper end portion 29*a* of the outlet side casing 14*b*. The intake side casing 14*a* and the outlet side casing 14*b* are joined to each other so as to be airtight, with an O ring (seal member 41) accommodated in a groove portion interposed therebetween, by a plurality of hexagon socket head bolts (omitted from illustration).

Now, the outlet side casing 14*b* may be a structure that is generally divided into two, which is a base spacer that is cylindrical in shape, and a base member that blocks off one end portion of this base spacer in the axial direction (the lower end portion in FIG. 1). The base spacer and the base member may respectively be referred to as "upper base" and "lower base", or the like. Also, heaters and coolant pipes for a temperature management system (TMS) may be provided in the outlet side casing 14*b*.

An exhaust mechanism unit 15 and a rotational driving unit (hereinafter referred to as "motor") 16 are provided in the main unit casing 14. Of these, the exhaust mechanism unit 15 is provided with a turbomolecular pump mechanism unit 17 that serves as a pump mechanism. A basic structure of the turbomolecular pump mechanism unit 17 will be described in brief below.

The turbomolecular pump mechanism unit 17 disposed at the upper side in FIG. 1 transports gas (process gas) as a fluid by a great number of turbine blades, and includes stator disks (also referred to "stator blades" and so forth) 19*a* to 19*e* and rotor discs (also referred to "rotor blades" and so forth) 20*a* to 20*e*, which are radially formed with predetermined inclinations and curved faces. In the turbomolecular pump mechanism unit 17, several sets (five sets here) or so of the stator discs 19*a* to 19*e* and the rotor discs 20*a* to 20*e* are disposed arrayed alternatingly.

Figure 2A:
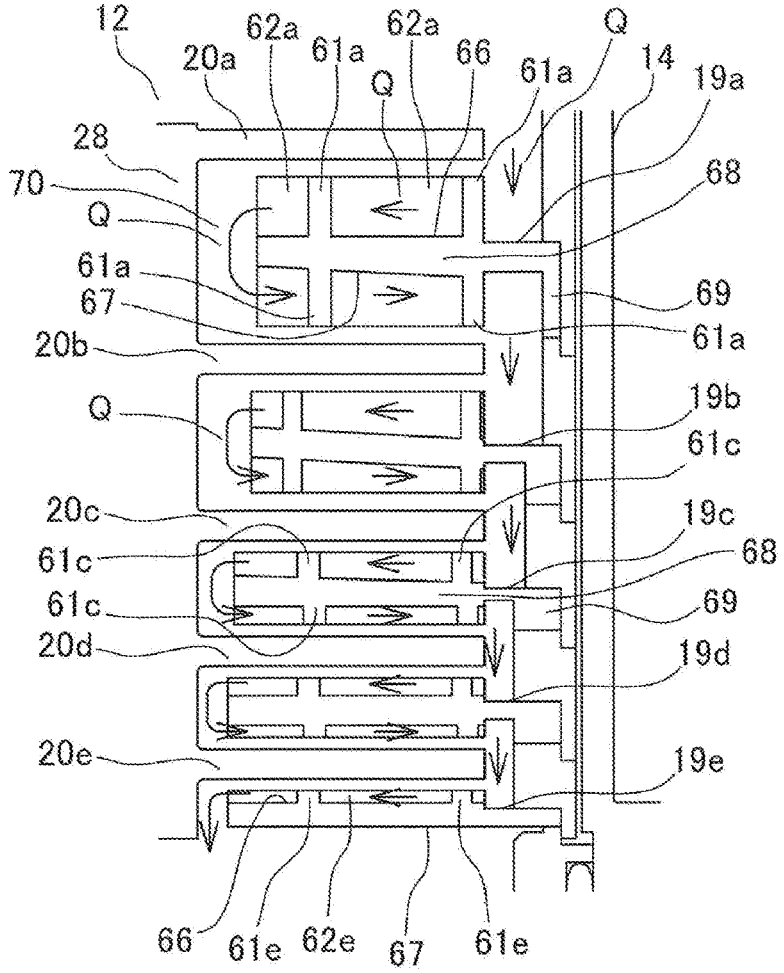
FIG. 2A is an enlarged view of part of FIG. 1.

In the present embodiment, an exhaust mechanism of a Siegbahn type (Siegbahn exhaust mechanism) is employed, in which helical grove portions (helical grooves) 62*a* to 62*e* are formed by a great number of ridge portions 61*a* to 61*e* that have rectangular cross-sectional shapes, between the stator discs 19*a* to 19*e* and the rotor discs 20*a* to 20*e*, of which a part is illustrated enlarged in FIG. 2A. Details of the ridge portions 61*a* to 61*e* and the helical groove portions 62*a* to 62*e* will be described later. Also, while the "helical groove portions" can also be referred to as "helical grooves", "helical groove channels", or the like, for example, the "helical groove portions" will be referred to as "groove portions" hereinafter.

The stator discs 19*a* to 19*e* are integrally attached to the main unit casing 14, with one stage of the rotor discs (20*a* to 20*e*) interposed between two stages, which are upper and lower, of the stator discs (19*a* to 19*e*). The rotor discs 20*a* to 20*e* are integrally formed with a rotor 28 that is cylindrical in shape, with the rotor 28 being concentrically fixed to a rotor shaft 21 so as to cover an outer side of the rotor shaft 21. The rotor discs 20*a* to 20*e* rotate in the same direction with the rotor shaft 21 and the rotor 28 under rotation of the rotor shaft 21.

Now, aluminum alloy is employed as a material of main parts of the pump main unit 11, and a material of the outlet side casing 14*b*, the stator discs 19*a* to 19*e*, the rotor 28, and so forth, also is aluminum alloy. Further, a material of the rotor shaft 21, various types of bolts (omitted from illustration), and so forth, is stainless steel. Note that in FIGS. 1, 2A, and 2B, hatching indicating cross-sections of parts in the pump main unit 11 is omitted from illustration, to keep the diagrams from becoming complicated.

The rotor shaft 21 is machined into a stepped cylinder shape, and reaches from the turbomolecular pump mechanism unit 17 to a thread groove pump mechanism unit 18 at the lower side. Further, the motor 16 is disposed at a middle portion of the rotor shaft 21 in the axial direction. This motor 16 will be described later.

Also, purging gas (protective gas) is supplied inside the main unit casing 14 of the turbomolecular pump 10. This purging gas is used to protect later-described bearing portions, the above-described rotor discs 20*a* to 20*e*, and so forth, and prevents corrosion by process gasses, cools the rotor discs 20*a* to 20*e*, and so forth. Supply of the purging gas may be performed by a common technique.

For example, a purging gas channel extending linearly in the radial direction is provided at a predetermined portion of the outlet side casing 14*b* (a position approximately 180 degrees away from an outlet port 25, or the like), although this is omitted from illustration. Purging gas is then supplied to this purging gas channel (more particularly, to a purging port serving as a gas inlet), from a purging gas cylinder (N2 gas cylinder) or via a gas regulator (valve device) or the like outside of the outlet side casing 14*b*. The purging gas flowing by the bearing portions and so forth passes through the outlet port 25 and is exhausted outside from the main unit casing 14.

The motor 16 has a rotor (sign omitted) that is fixed on an outer circumferential face of the rotor shaft 21, and a stator (sign omitted) that is disposed surrounding the rotor. Supply of electric power for running the motor 16 is performed by the power source circuit unit and the control circuit unit accommodated in the above-described electrical component case (omitted from illustration).

Magnetic bearings, which are non-contact bearings using magnetic levitation, are used for bearing the rotor shaft 21. Two radial magnetic bearings 30 disposed above and below the motor 16, and one axial magnetic bearing 31 disposed at a lower portion of the rotor shaft 21, are used as the magnetic bearings.

Of these, each of the radial magnetic bearings 30 includes radial electromagnet targets 30A that are formed on the rotor shaft 21, a plurality of (e.g., two) radial electromagnets 30B facing the radial electromagnet targets 30A, a radial orientation displacement sensor 30C, and so forth. The radial orientation displacement sensor 30C detects radial orientation displacement of the rotor shaft 21. An exciting current of the radial electromagnets 30B is controlled on the basis of output of the radial orientation displacement sensor 30C, and the rotor shaft 21 is borne levitated, so as to be rotatable about a shaft center at a predetermined position in the radial direction.

The axial magnetic bearing 31 includes an armature disc 31A that is disc-shaped and that is attached to a portion at a lower end side of the rotor shaft 21, axial electromagnets 31B that face each other from above and below across the armature disc 31A, an axial orientation displacement sensor 31C that is disposed at a position somewhat away from a lower end face of the rotor shaft 21, and so forth. The axial orientation displacement sensor 31C detects axial-direction displacement of the rotor shaft 21. Exciting currents of the upper and lower axial electromagnets 31B are controlled on the basis of output of the axial orientation displacement sensor 31C, and the rotor shaft 21 is borne levitated so as to be rotatable about the shaft center at a predetermined position in the axial direction.

Using these radial magnetic bearings 30 and axial magnetic bearing 31 realizes an environment in which there is no wear when the rotor shaft 21 (and the rotor blades 20) rotate at high speeds, life expectancy is long, and no lubricant is necessary. Also, in the present embodiment, by using the radial orientation displacement sensor 30C and the axial orientation displacement sensor 31C, only rotation in a direction θz about the axial direction (Z direction) is freely performed with respect to the rotor shaft 21, and position control is performed regarding the remaining five axial directions X, Y, Z, θx, and θy.

Further, provided around an upper portion and the lower portion of the rotor shaft 21 with a predetermined spacing therebetween are radial-direction protective bearings (also referred to as "touchdown (T/D) bearings", "backup bearings", and so forth) 32 and 33. Due to these protective bearings 32 and 33 being provided, even in a case in which trouble occurs in an electrical system, or trouble such as intrusion of ambient atmosphere occurs, for example, the position and orientation of the rotor shaft 21 does not greatly change, and the rotor discs 20*a* to 20*e* and parts in the vicinity thereof can be kept from being damaged.

Further, the rotor shaft 21, the rotor discs 20 that rotate integrally with the rotor shaft 21, a rotor cylindrical portion 23, the rotor (sign omitted) of the motor 16, and so forth, may be collectively referred to as "rotor portion", "rotating portion", or the like, for example.

Next, the above-described stator discs 19*a* to 19*e*, the ridge portions 61*a* to 61*e* and the groove portions 62*a* to 62*e* provided to the stator discs 19*a* to 19*e*, and so forth, will be described. First, in the present embodiment, five sets of the stator discs 19*a* to 19*e* and the rotor discs 20*a* to 20*e* are provided, as described earlier.

Further, in the present embodiment, the stator discs 19*a* to 19*e* and the rotor discs 20*a* to 20*e* are disposed alternating in the order of the rotor disc 20*a*, the stator disc 19*a*, the rotor disc 20*b*, the stator disc 19*b*, and so on through the rotor disc 20*e*, and the stator disc 19*e*, from the side of the inlet portion 12 toward the side of the outlet portion 13 (from the upper side toward the lower side in FIG. 1).

FIG. 2A illustrates part of the stator discs 19*a* to 19*e* and the rotor discs 20*a* to 20*e* in FIG. 1 enlarged. FIG. 2A further illustrates a right-side part of the turbomolecular pump mechanism unit 17 in FIG. 1 enlarged. Note that the stator discs 19*a* to 19*e* and the rotor discs 20*a* to 20*e* are structured in line symmetry, with the axial center of the main unit casing 14, the rotor shaft 21, and so forth, as the center of symmetry (bilaterally symmetrical in FIG. 1), and accordingly, only the right-side part of FIG. 1 is illustrated here, and illustration of the left-side part is omitted.

As illustrated in FIG. 2A, the ridge portions 61*a* to 61*e* on the stator discs 19*a* to 19*e* are formed integrally with the stator discs 19*a* to 19*e*. Further, on the first through fourth stator discs 19*a* to 19*d* from the side of the inlet portion 12 upward in the Figures (hereinafter referred to as "intake side", "upstream side", or the like), the ridge portions 61*a* to 61*d* are formed on both plate faces 66 on the intake side (upstream side) and plate faces 67 on the side of the outlet portion 13 (hereinafter referred to as "outlet side", "downstream side", or the like).

Also, the ridge portions 61*e* are formed only on the intake side (upstream side) plate face 66 at the stator disc 19*e* the fifth from the intake side (upstream side) (the first from the outlet side (downstream side), and no ridge portion 61*e* is formed on the outlet side (downstream side) plate face 67.

Hereinafter, description will be made using the signs of the plate faces 66 and 67 in common among the stator discs 19*a* to 19*e*, and the same signs (signs 66 and 67 here) will be used to denote different stator discs 19*a* to 19*e*. Also, in FIG. 2A, the signs for the plate faces 66 and 67 are indicated only for the stator disc 19*a* closest to the intake side (upstream side) and for the stator disc 19*e* closest to the outlet side (downstream side), and inscription of signs for the plate faces 66 and 67 is omitted for the other stator discs 19*b* to 19*d*, to keep the diagram from becoming complicated.

Figure 3B:
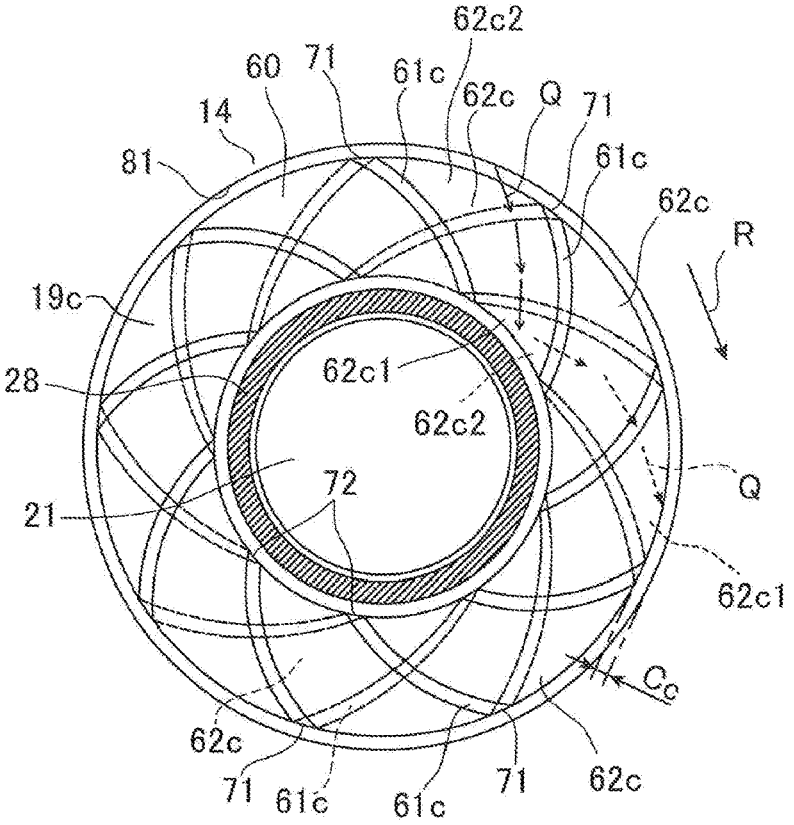
FIG. 3B is an explanatory diagram schematically illustrating a downstream side of the stator disc in FIG. 3A as viewed from an oblique angle.
Figure 3B:
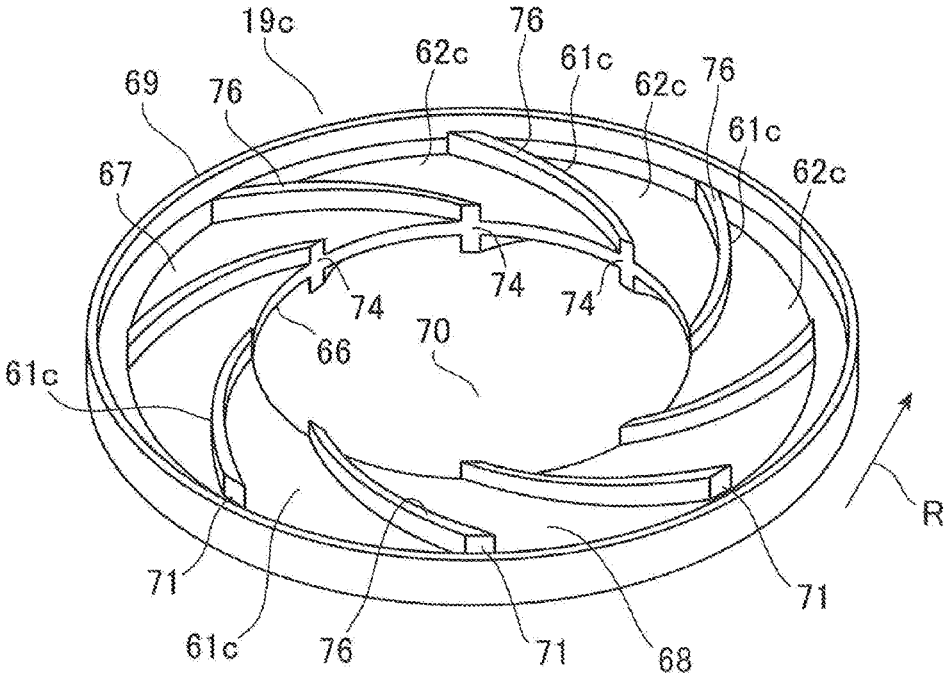

Also, a plurality of (eight here) the ridge portions (sign 61*c* here) is provided to each of the plate faces 66 and 67 of the stator discs 19*a* to 19*e* (only on one plate face 66 for the fifth stator disc 19*e*), as exemplified by the third stator disc 19*c* in FIGS. 3A and 3B.

Now, FIG. 3A schematically illustrates the stator disc 19*c* as viewed in the axial direction from the side of the plate face 66 on the upstream side. Also, FIG. 3B schematically illustrates the stator disc 19*c* as viewed from the side of the plate face 67 on the downstream side from an oblique angle.

Further, in the present embodiment, with respect to the individual stator discs 19*a* to 19*e*, all of the ridge portions are denoted by common signs (signs 61*a* to 61*e*) regardless of difference in plate faces 66 and 67. Also, in the same way, all of the groove portions 62*a* to 62*e* are denoted by common signs (signs 62*a* to 62*e*) regardless of difference in plate faces 66 and 67.

On each of the stator discs 19*a* to 19*e* the ridge portions 61*a* to 61*e* protrude, at predetermined angles set for each, from the plate faces 66 and 67 that are both faces of a main unit portion (disc-shaped portion) 68 that is disc-shaped. Also, the thickness of the main unit portion 68 of the first stator disc 19*a* from the upstream side changes to gradually become thinner from an outer circumferential side that is a base end side toward an inner circumferential side that is a distal end side in the present embodiment, although detailed description thereof will be omitted.

Here, the term "outer circumferential side" means an outer side with respect to a normal direction (radial direction) of the main unit portion 68 of the stator discs 19*a* to 19*e*, and "inner circumferential side" means an inner side with respect to the normal direction (radial direction) of each main unit portion 68, in the same way. Further, relative rotational directions between the stator discs 19*a* to 19*e* and the rotor discs 20*a* to 20*e* may be referred to as "tangential direction" when used linearly, "circumferential direction" when used curvilinearly, and so forth.

The thicknesses of the main unit portions 68 of the second through fifth stator discs 19*b* to 19*e* are approximately constant. Also, the amount of protrusion of the ridge portions 61*a* to 61*e* from the main unit portions 68 of the five stator discs 19*a* to 19*e* is not uniform, and differ each from another.

In more detailed description of the stator discs 19*a* to 19*e* and the rotor discs 20*a* to 20*e*, the main unit portions 68 of the stator discs 19*a* to 19*e* are not machined to all have the same thickness and uniform thickness, and each is formed having an individually unique thickness and inclination.

Further, when giving description with reference to an inner circumferential face 81 of the main unit casing 14, for example, the main unit portions 68 of the stator discs 19*a* to 19*e* do not all extend at right angles from the inner circumferential face 81. There are some of the plate faces 66 on the upstream side and the plate faces 67 on the downstream side of the main unit portions 68 that are inclined at an angle smaller than a right angle, and some that are inclined at an angle greater than a right angle, with respect to the inner circumferential face 81.

Further, in the present embodiment, an amount of protrusion of the ridge portions 61*a* and 61*b* of the first and second stator discs 19*a* and 19*b* from the upstream side is overall greater in comparison with the amount of protrusion of the ridge portions 61*c* to 61*e* of the third to fifth stator discs 19*c* to 19*e*. Also, the amount of protrusion of the ridge portions 61*c* to 61*e* of the third to fifth stator discs 19*c* to 19*e* is not the same as each other, and the amount of protrusion becomes overall smaller the farther in the direction of the third disc toward the fifth disc.

Further, due to the amount of protrusion of the ridge portions 61*a* to 61*e* of the stator discs 19*a* to 19*e* differing in this way, axial direction spacings between the rotor discs 20*a* to 20*e* among which the stator discs 19*a* to 19*e* are interposed differ from each other in accordance with the size of the stator discs 19*a* to 19*e*. The farther toward the downstream side from the upstream side, the smaller the spacings between the rotor discs 20*a* to 20*e* are.

The above term "size of the stator discs 19*a* to 19*e*" can be defined as, for example, "distance (axial-direction distance) from a tip end of each of the ridge portions 61*a* to 61*e* on one plate face 66 to a tip end of each of the ridge portions 61*a* to 61*e* on the other plate face 67", or "A total amount of thickness of the main unit portion 68 and the amount of protrusion of the ridge portions 61*a* to 61*e* on both plate faces 66 and 67 (one plate face 66 for the fifth stator disc 19*e*), with respect to the stator discs 19*a* to 19*e*".

In the present embodiment, this "size of the stator discs 19*a* to 19*e*" is approximately the same (uniform) over a range from a middle side near the rotor 28 to the outer circumferential side thereof, for each of the stator discs 19*a* to 19*e*.

Further, with regard to the rotor discs 20*a* to 20*e*, the thickness of each of the rotor discs 20*a* to 20*e* is approximately uniform over a range from a middle side near the rotor 28 to the outer circumferential side thereof. Also, a thickness relation among the rotor discs 20*a* to 20*e* is approximately the same (common). Further, the amount of protrusion from the rotor 28 is approximately the same (common) as each other for the rotor discs 20*a* to 20*e*, and accordingly end faces of the rotor discs 20*a* to 20*e* on the outer circumference thereof match each other in the axial direction over the entire circumference thereof.

Next, the ridge portions 61*a* to 61*e* and the groove portions 62*a* to 62*e* will be described in further detail. The stator discs 19*a* to 19*e* differ in detailed shapes and dimensions and so forth, as described above, but exhibit similar functions in the compression principle of gas (process gas). Accordingly, only a relation between one stator disc (the third stator disc 19*c* from the upstream side) illustrated in FIGS. 3A and 3B and the rotor discs 20*c* and 20*d* in the vicinity, and so forth, will be described here, and description regarding the other stator discs 19*a*, 19*b*, 19*d*, and 19*e* will be omitted as appropriate.

The stator disc 19*c* illustrated in FIGS. 3A and 3B has the main unit portion 68 that is disc-shaped, and the plurality of (eight each on either side here) ridge portions 61*c* and groove portions 62*c*, as described earlier. A Siegbahn exhaust mechanism 60 is formed on the stator disc 19*c*, by the ridge portions 61*c* and the groove portions 62*c*.

Now, the phrase "Siegbahn exhaust mechanism" in the present embodiment can be used in increments of one groove portion 62*c* on one plate face 66, or can be used in increments of the plurality of groove portions 62*c*.

Also, the phrase "Siegbahn exhaust mechanism" may be used with regard to an exhaust mechanism made up of channels spanning both plate faces 66 and 67 on the upstream side and the downstream side of the single stator disc 19*c*. Further, the phrase "Siegbahn exhaust mechanism" may be used with regard to an exhaust mechanism made up of channels configured between the stator disc 19*c* and the rotor disc 20*b* (or the rotor disc 20*d*), or to an exhaust mechanism made up of a plurality of stator discs and rotor discs.

Further, as illustrated in FIG. 3B, an upright wall portion (spacer) 69 used for fixing to the main unit casing 14 is formed on an outer circumferential edge portion of the main unit portion 68, at an approximate right angle to the main unit portion 68, and at a uniform height.

Figure 2B:
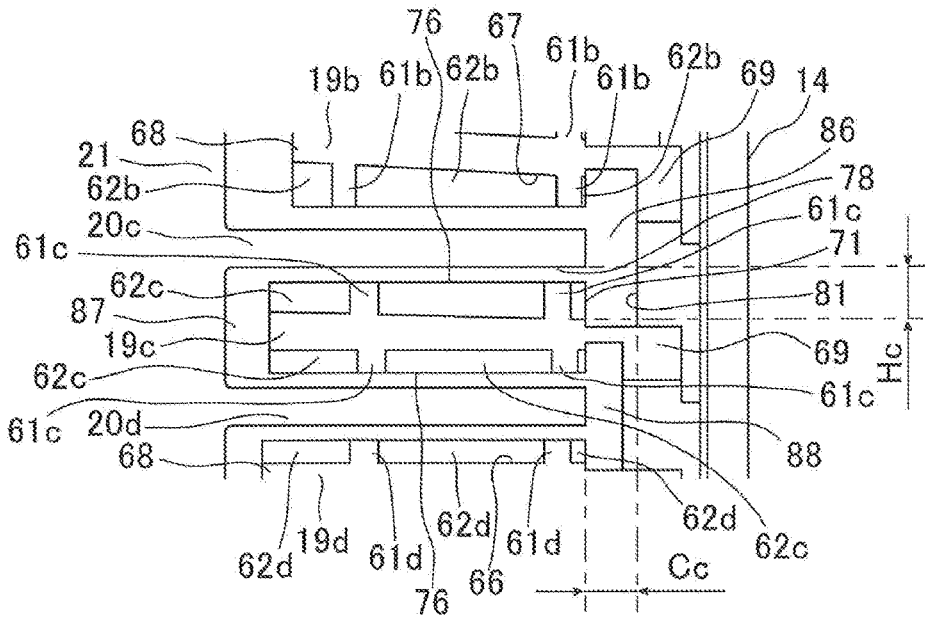
FIG. 2B is a further enlarged view of part of FIG. 2A.

In FIG. 3B, the stator disc 19*c* is illustrated with the upright wall portion 69 extending upward from the main unit portion 68, but in FIG. 1 and FIGS. 2A and 2B, the upright wall portion 69 is illustrated as extending downward from the main unit portion 68. That is to say, in FIG. 3B, the plate face 66 on the upward side of the main unit portion 68 is facing downward, and the plate face 67 on the downward side is facing upward, but in FIG. 1 and FIGS. 2A and 2B, the plate face 66 on the upstream side of the main unit portion 68 is facing upward, and the plate face 67 on the downward side is facing downward.

through hole 70 through which the rotor 28 and so forth pass is formed at a middle portion of the main unit portion 68, as an exact circle, as illustrated in FIGS. 3A and 3B. Further, the ridge portions 61*c* are helically formed on the plate faces 66 and 67 of the main unit portion 68, with the middle of the main unit portion 68 as the center thereof. The ridge portions 61*c* extend as smooth curves from a circumferential portion of the through hole 70 to positions just short of the upright wall portion 69.

Now, FIG. 3A schematically illustrates the stator disc 19*c* in frontal view from the upstream side. Conversely, FIG. 3B schematically illustrates the stator disc 19*c* from the downstream side at an oblique angle. In FIG. 3A that illustrates the stator disc 19*c* from the upstream side, the ridge portions 61*c* formed on the plate face 66 on the upstream side are illustrated by solid lines, and the ridge portions 61*c* formed on the plate face 67 on the downstream side are illustrated by dashed lines. Also, the upright wall portion 69 is omitted from illustration in FIG. 3A.

The upright wall portion 69 is assembled to the main unit casing 14 and makes up part of the main unit casing 14. Further, an inner circumferential face of the upright wall portion 69 makes up part of the aforementioned inner circumferential face 81 of the main unit casing 14. Upright wall portions 69 are also formed on the other stator discs 19*a*, 19*b*, 19*d*, and 19*e* as well, and also function as spacers that regulate spacings among the stator discs 19*a* to 19*e* in the axial direction by being assembled into the main unit casing 14.

On the plate face 66 on the upstream side of the stator disc 19*c*, the outer circumferential side of the main unit portion 68 serves as a start portion 62*c*2 side (fluid inlet guide side), as illustrated by a solid line arrow Q showing a transport direction of gas (process gas), and the inner circumferential side of the main unit portion 68 serves as an end portion 62*c*1 side (fluid outlet guide side). Also, on the plate face 67 on the downstream side, the inner circumferential side of the main unit portion 68 serves as the start portion 62*c*2 side (fluid inlet guide side), as illustrated by a dashed line arrow Q showing the transport direction of gas, and the outer circumferential side of the main unit portion 68 serves as the end portion 62*c*1 side (fluid outlet guide side).

Now, arrows R in FIGS. 3A and 3B indicate a direction of rotation of the rotor disc 20*d* and so forth with regard to relative rotational displacement. Also, only a cylindrical portion of the rotor 28 surrounding the outer circumference of the rotor shaft 21 (rotor cylinder portion) is illustrated hatched in FIG. 3A, to keep the diagram from becoming complicated.

Further, switchback portions 86 to 88 having spatial switchback structures with respect to the gas channels are formed on the outer circumferential side and the inner circumferential side of the main unit portion 68, as illustrated in FIG. 2B. First, with respect to the plate face 66 on the upstream side of the main unit portion 68, the switchback portions 86 on the outer circumferential side are formed spanning the groove portions 62*b* of the plate face 67 on the downstream side of the second stator disc 19*b*, the rotor disc facing the upstream side (the rotor disc 20*c* here), and the groove portions 62*c* of the plate face 66 on the upstream side of the third stator disc 19*c*.

Also, with respect to an inner circumferential side of the third stator disc 19*c*, the switchback portions 87 on the inner circumferential side are formed spatially connecting the groove portions 62*c* of both plate faces 66 and 67 across the main unit portion 68 of the stator disc 19*c*.

Further, with respect to the plate face 67 on the downstream side of the main unit portion 68, the switchback portions 88 on the outer circumferential side are formed spanning the groove portions 62*c* of the plate face 67 on the downstream side, the rotor disc facing the downstream side (the rotor disc 20*d* here), and the groove portions 62*d* of the plate face 66 on the upstream side of the fourth stator disc 19*d*.

At the switchback portions 86 (and 88) on the outer circumferential side with respect to the third stator disc 19*c* described above, end faces (hereinafter referred to as "outer side end faces") 71 of the respective ridge portions 61*c* on both plate faces 66 and 67 (FIGS. 3A and 3B) protrude from the plate faces 66 and 67 and are exposed. Further, the ridge portions 61*c* and the groove portions 62*c* on the stator disc 19*c* are formed on the upstream side plate face 66 and the downstream side plate face 67 in-phase with each other, with respective start portions (start portions) as points of origin thereof.

Accordingly, the outer side end faces 71 of the ridge portions 61*c* on both plate faces 66 and 67 of the main unit portion 68 protrude opposite to each other with respect to the thickness direction of the main unit portion 68, and are formed at the same positions with respect to the circumferential direction of the main unit portion 68. The groove portions 62*c* partitioned by the ridge portions 61*c* are also formed such that the end portions 62*c*1 of the groove portions 62*c* provided on the plate face 66 on the upstream side and the start portions 62*c*2 of the groove portions 62*c* provided on the plate face 67 on the downstream side are overlaid in the circumferential direction overall (so as to be arrayed in the thickness direction of the main unit portion 68), and formed so as to spatially continue to each other.

Further, the outer side end faces 71 of these ridge portions 61*c* face the inner circumferential face 81 of the main unit casing 14. A clearance Cc between the outer side end faces 71 of the ridge portions 61*c* and the inner circumferential face 81 of the main unit casing 14 (FIGS. 2B and 3A) is defined with an association to a distance (clearance) Hc between the main unit portion 68 of the stator disc 19*c* and the surface (plate face 78 on the downstream side here) of the opposing rotor disc (the rotor disc 20*c* here).

That is to say, the clearance Cc between the outer side end faces 71 of the ridge portions 61*c* and the inner circumferential face 81 of the main unit casing 14 can be said to be the width of the channel at the switchback portion 86. Also, the distance Hc between the main unit portion 68 of the stator disc 19*c* and the rotor disc 20*c* can be said to be the depth of a channel of the Siegbahn exhaust mechanism. Hereinafter, the clearance Cc will be referred to as "width Cc of the channel at the switchback portion", and the height Hc of the ridge portions will be referred to as "depth Hc of the channel of the Siegbahn exhaust mechanism". Note that the depth Hc of the channel of the Siegbahn exhaust mechanism (distance between the main unit portion 68 of the stator disc 19*c* and the rotor disc 20*c*) can also be described approximatively by the height of the ridge portions 61*c*.

Over the entire circumference of the stator disc 19*c*, the width Cc of the channels at the switchback portions is formed to be around the same as the depth Hc of the channels of the Siegbahn exhaust mechanism. The height of the outer side end faces 71 of the ridge portions 61*c* (amount of protrusion from the plate face 66 on the upstream side) is employed as the depth Hc of the channels of the Siegbahn exhaust mechanism here.

This depth Hc of the channels of the Siegbahn exhaust mechanism is a value within a range of around 2 mm to 3 mm (e.g., 2 mm), and the width Cc of the channels at the switchback portions is a value that is the same as (equivalent to) the depth Hc of the channels of the Siegbahn exhaust mechanism (e.g., 2 mm). Note that the present embodiment is not necessarily limited to these being the same, and Hc may be set to 3 mm while Cc is set to 2 mm, for example, as long as effective compression effects such as described later can be obtained. By realizing such structures, local pressure rise can be suppressed as compared with a case of providing protrusions at switchback portions such as described in aforementioned Japanese Patent No. 6616560, for example, and accordingly effects of reduced product matter can be anticipated.

Further, the invention according to the present application is not limited to the depth Hc of the channel of the Siegbahn exhaust mechanism being constant in the width direction (circumferential direction or tangential direction), and this depth Hc and the width Cc of the channel at the switchback portion being the same (equivalent). For example, the depth Hc of the channel of the Siegbahn exhaust mechanism in the width direction (circumferential direction or tangential direction) may change, and the width Cc may match the depth (Hc) only partially, as long as similar compression effects can be obtained.

Also, in the present embodiment, the ridge portions 61*c* protruding from both plate faces 66 and 67 of the main unit portion 68 have tip end faces 76 thereof each facing the rotor disc 20*c* on the upstream side and the rotor disc 20*d* on the downstream side, over the entire length thereof. The clearance (sign omitted) between the tip end faces 76 of the ridge portions 61*c* and the rotor disc 20*c* on the upstream side is around 1 mm.

Note that when the turbomolecular pump 10 is operating, the width Cc of the channel at the switchback portions and the clearance (sign omitted) between the tip end faces 76 of the ridge portions 61*c* and the rotor disc 20*c* on the upstream side change due to thermal expansion. Further, the depth Hc of the channel of the Siegbahn exhaust mechanism also changes due to thermal expansion.

Figure 4:
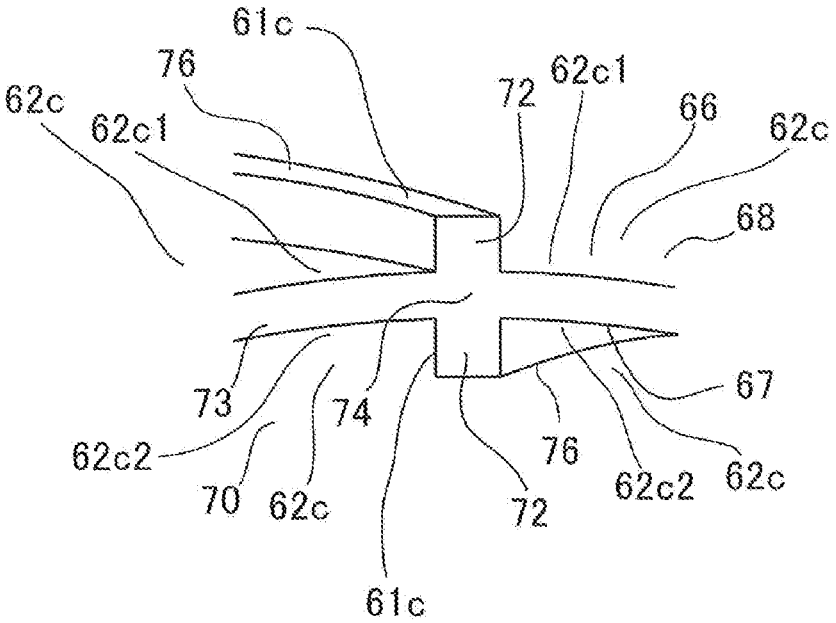
FIG. 4 is a perspective view in which part of an inner circumferential portion of the stator disc is enlarged.

Next, the inner circumferential side of the main unit portion 68 (inner side with respect to direction of normal) will be described. FIG. 4 schematically illustrates a part thereof enlarged, in which an end face 72 on a middle side of the main unit portion 68 (hereinafter referred to as "inner side end face") at each of the ridge portions 61*c* of both plate faces 66 and 67 smoothly connects to an inner circumferential face (hereinafter referred to as "inner circumferential face of main unit portion 68") 73 of the through hole 70, with no steps formed. The inner side end faces 72 of two ridge portions 61*c* and the inner circumferential face 73 of main unit portion 68 that is annular in shape forma continuous face 74 that is a smoothly continuing cross-shaped curved face.

Although only one portion is illustrated in FIG. 4, continuous faces 74 are formed in the same way at positions where the inner side end faces 72 of the other ridge portions 61*c* are situated as well. The number of continuous faces 74 on the stator disc 19*c* according to the present embodiment is eight.

Also, at each of the continuous faces 74, the inner side end face 72 of the ridge portion 61*c* on the plate face 66 on the upstream side (first ridge portion) and the inner side end face 72 of the ridge portion 61*c* on the plate face 67 on the downstream side (second ridge portion) are disposed so as to be situated at least partially on a same straight line with respect to the thickness direction of the main unit portion 68.

Figure 5A:
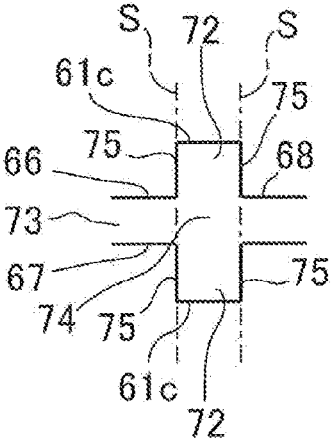
FIG. 5A is an explanatory diagram illustrating a positional relation of ridge portions according to the embodiment of the present invention.

Various types of arrangements can be conceived regarding the term here "situated at least partially on a same straight line", which will be described later. For example, a form can be exemplified in which side faces (side portions of helical grooves) 75 of two ridge portions 61*c* are situated on the same straight line (on straight lines S) in the thickness direction of the main unit portion 68, as schematically illustrated in FIG. 5A, which is a partially enlarged view of the inner circumferential portion of the main unit portion 68 (portion facing the through hole 70) as viewed from the inner circumferential side toward the outer circumferential side (inner side to outer side with respect to direction of normal), as an example. This form is employed in the present embodiment illustrated in FIG. 1, FIGS. 2A and 2B, and FIGS. 3A and 3B and so forth.

Figure 5B:
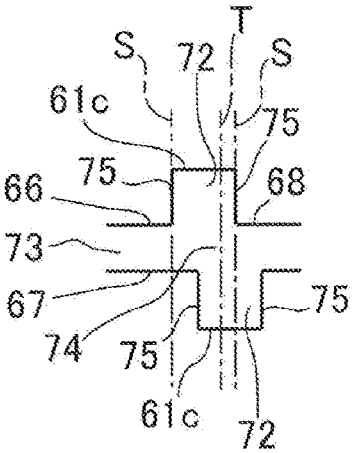
FIG. 5B is an explanatory diagram illustrating a modification relating to the positional relation of the ridge portions.

However, the above term "situated at least partially on a same straight line" is not limited to this, and a form can be exemplified in which the side faces 75 of both ridge portions 61*c* are not situated on the same straight line (on straight lines S) in the thickness direction of the main unit portion 68, but both ridge portions 61*c* are partially situated on the same straight line as each other (on straight line T), as illustrated in FIG. 5B, for example.

Figure 5C:
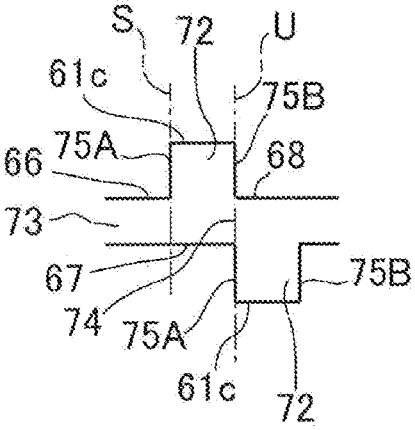
FIG. 5C is an explanatory diagram illustrating another modification relating to the positional relation of the ridge portions.

Also, a form can be exemplified in which the positions of both ridge portions 61*c* are moved (also referred to as "shifted" or "deviated") in circumferential directions by an amount equivalent to thicknesses thereof, so that one side face (side portion of helical groove) 75B of a certain ridge portion 61*c* and the other side face (side portion of helical groove) 75A of the ridge portion 61*c* protruding to the other side are situated on the same straight line (on straight line U), as illustrated in FIG. 5C, for example. Such a form can be expressed as, for example, a form in which diagonally-situated side faces (or ridge lines) of opposite-facing ridge portions 61*c* are in-phase, in the circumferential direction with respect to the stator disc 19*c*, and so forth.

Figure 5D:
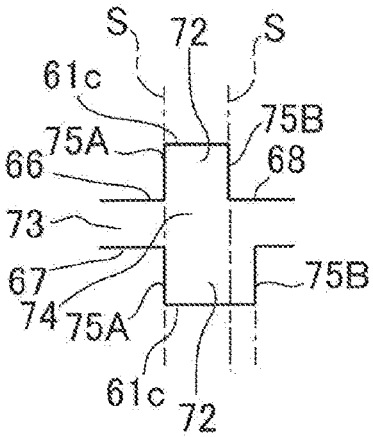
FIG. 5D is an explanatory diagram illustrating yet another modification relating to the positional relation of the ridge portions.

Further, an arrangement is conceivable in which the thicknesses of both ridge portions 61*c* are made to differ from each other, as illustrated in FIG. 5D. In such a case, a form is conceivable in which, for example, one of the side faces 75A are situated on the same straight line (on straight lines S) but the other of the side faces 75B are not situated on the same straight line (on straight lines S).

With regard to the outer circumferential side of the plate face 67 on the downstream side of the third stator disc 19*c* and the outer circumferential side of the plate face 66 on the upstream side of the fourth stator disc 19*d* as well, the outer side end faces 71 of the ridge portions 61*c* (first ridge portions) of the third stator disc 19*c* and the outer side end faces 71 of the ridge portions 61*d* (second ridge portions) of the fourth stator disc 19*d* are also disposed so as to be "situated at least partially on a same straight line" in the same way, although omitted from illustration.

For the positional relation among the outer side end faces 71 of each other, a form the same as that of the ridge portions 61*c* illustrated in FIG. 5A described earlier is employed. This is not limiting, and forms that are the same as the forms of the ridge portions 61*c* illustrated in FIGS. 5B to 5D described earlier may be employed.

Describing the groove portions 62*c* that are partitioned by such ridge portions 61*c* in further detail, the outer circumferential sides thereof are relatively broad (with wide opening widths) on each of the plate faces 66 and 67, as illustrated in FIGS. 3A and 3B. Further, the inner circumferential sides of the groove portions 62*c* are relatively narrow (with narrow opening widths). Each groove portion 62*c* is partitioned by two ridge portions 61*c* on either plate face 66 and 67, and the groove portions 62*c* are formed helically centered on the middle of the main unit portion 68.

As described earlier, the groove portions 62*c* are formed spatially continuing in-phase with each other on both plate faces 66 and 67 of the main unit portion 68. Also, there is continuation between the second stator disc 19*b* and the third stator disc 19*c* via the switchback portions 86 in the same way, as described earlier. Further, there is continuation between the groove portions 62*c* formed on the plate face 66 on the upstream side of the third stator disc 19*c* and groove portions 62*c* formed on the plate face 67 on the downstream side via the switchback portions 87. Also, there is continuation between the third stator disc 19*c* and the fourth stator disc 19*d* via the switchback portions 88.

When operating the turbomolecular pump 10 having such a structure, the motor 16 is driven, and the rotor discs 20*a* to 20*e* rotate. Relative rotational displacement is thus carried out between the stator discs 19*a* to 19*e* and the rotor discs 20*a* to 20*e*. Further, gas (process gas) is sucked in from the inlet portion 12, and gas is transported between the rotor discs 20*a* to 20*e* facing each other, with the plate faces 66 on the upstream sides of the stator discs 19*a* to 19*e* as upstream regions and the plate faces 67 on the downstream sides as downstream regions, as indicated by a great number of arrows Q (only part indicated by signs) in FIGS. 1 and 2A.

Such transporting of gas is performed by causing gas molecules to collide with the stator discs 19*a* to 19*e* and the rotor discs 20*a* to 20*e*. Gas that is compressed while being transported enters the outlet port 25 through the outlet portion 13 and is exhausted from the pump main unit 11 via the outlet port 25.

Specifically, gas sucked in from the inlet portion 12 passes between the first rotor disc 20*a* and the first stator disc 19*a*, between the first stator disc 19*a* and the second rotor disc 20*b*, between the second rotor disc 20*b* and the second stator disc 19*b*, between the second stator disc 19*b* and the third rotor disc 20*c*, and reaches the third stator disc 19*c*. Further the gas that has reached the third stator disc 19*c* passes between the third stator disc 19*c* and the fourth rotor disc 20*d*, between the fourth rotor disc 20*d* and the fifth stator disc 19*e*, and is guided out by the outlet portion 13.

To describe byway of example of the third stator disc 19*c*, on the plate face 66 on the upstream side of the stator discs 19*c*, the gas being transported is guided into the groove portions 62*c* from the outer circumferential side. Further, the gas guided into the groove portions 62*c* is transported from the outer circumferential side of the main unit portion 68 toward the inner circumferential side.

The groove portions 62*c* are relatively broad on the outer circumferential sides, and the inner circumferential sides are relatively narrow, as described earlier. At the plate face 66 on the upstream side, the groove portions 62*c* are sectioned by the ridge portions 61*c* so as to gradually narrow from the fluid inlet guide side (outer circumferential side serving as the start portions 62*c*2) toward the fluid outlet guide side (inner circumferential side serving as the end portions 62*c*1). Further, the groove portions 62*c* are also sectioned by the third rotor disc 20*c* in close proximity to the ridge portions 61*c*, with a slight gap (the above-described gap around 1 mm) interposed therebetween.

On the plate face 67 on the downstream side, the groove portions 62*c* are sectioned by the ridge portions 61*c* so as to gradually widen from the fluid inlet guide side (inner circumferential side serving as the start portions 62*c*2) toward the fluid outlet guide side (outer circumferential side serving as the end portions 62*c*1). Further, the groove portions 62*c* are also sectioned by the fourth rotor disc 20*d* in close proximity to the ridge portions 61*c*, with a slight gap (the above-described gap around 1 mm) interposed therebetween.

At the end portions 62*c*1 of the groove portions 62*c* on the plate face 67 on the downstream side of the third stator disc 19*c*, the outer side end faces 71 of the ridge portions 61*c* face the inner circumferential face 81 of the main unit casing 14 across the width Cc of the channel at the switchback portions (88), as illustrated in FIGS. 2B and 3A. The groove portions 62*c* are spatially connected to the switchback portions 88 that connect to the fourth stator disc 19*d* across this width Cc of the channel at the switchback portions (88), so that there is no discontinuation of exhaust effects.

Accordingly, gas is guided into the groove portions 62*c* along with relative rotational displacement between the stator disc 19*c* and the rotor disc 20*c*, and within the groove portion 62*c*, the dispersed gas molecules are imparted with linear direction kinetic momentum by the rotor disc 20*c*. Further, the groove portion 62*c* gives the gas molecules advantageous directionality toward the exhaust direction, and exhausting is performed.

The direction of transport of gas is switched back at the outer circumferential side of the plate face 67 on the downstream side, using the inner circumferential face 81 of the main unit casing 14, and gas is transported toward the groove portions 62*d* on the plate face 66 on the upstream side of the next-stage stator disc (the stator disc 19*d* here).

Figure 6A:
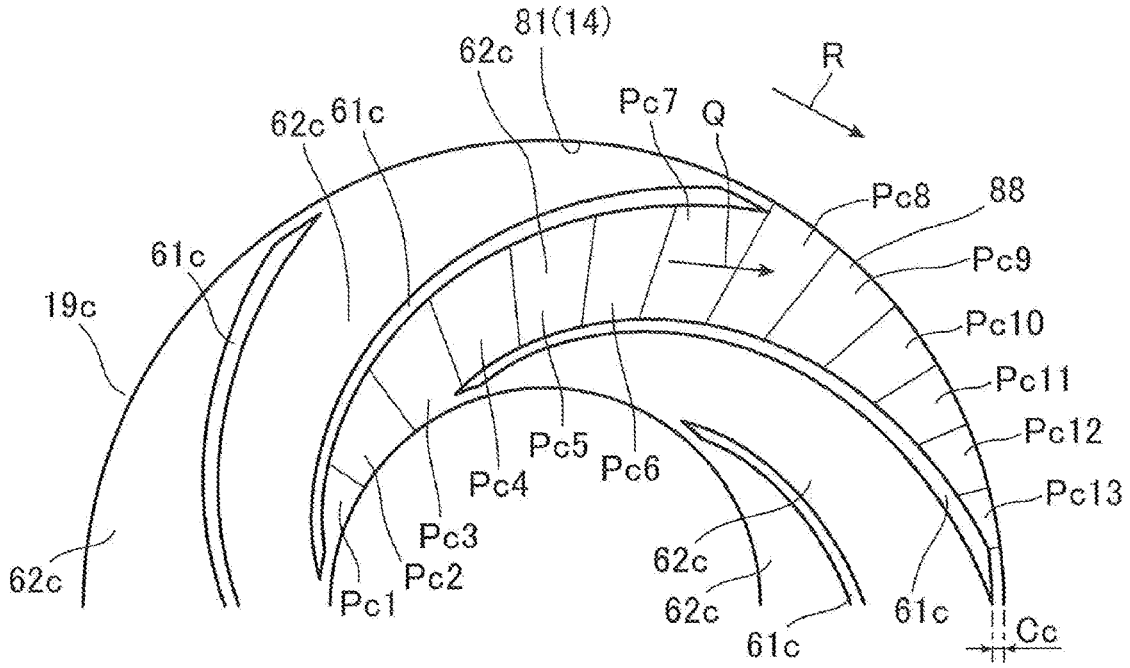
FIG. 6A is an explanatory diagram schematically illustrating part of simulation results of compression effects of the stator disc according to the embodiment of the present invention.

Simulation results relating to a pressure distribution such as illustrated in FIG. 6A were obtained by the turbomolecular pump 10 having such a structure. FIG. 6A schematically illustrates part of pressure distribution at the plate face 67 on the downstream side of the stator disc 19*c* enlarged. Further, the simulation results illustrated in FIG. 6A are obtained by tracing a color image obtained by computer computation, with boundary portions of each of pressure regions that were color-coded in the original color image being indicated by solid lines.

The pressure distribution is relatively high at the outer circumferential side on the plate face 67 on the downstream side, and is relatively low at the inner circumferential side. In FIG. 6A, boundaries of pressure regions are schematically drawn by monotone lines for one groove portion 62*c*, and signs Pc1 to Pc13 are imparted to the pressure regions. Accordingly, the pressure in the region indicated by Pc1 is the lowest, and the pressure gradually (stepwise) increases in the order of Pc1, Pc2, and so on through Pc12, and Pc13. Between the pression regions Pc1 and PC13 on both end portions, pressure regions that can be said to have generally parallelogram or trapezoid shapes (Pc2 to Pc12) are manifested at approximately equal widths.

The shape (projected shape) of the pressure region Pc13 situated on the farthest outer circumferential side can be expressed as being a wedge shape that is sharp-pointed toward the outer circumferential side. This wedge-shaped pressure region Pc13 is the region of greatest pressure (greatest pressure region) on the plate face 67 on the downstream side of the stator disc 19*c*, as described above, and is similarly manifested in all groove portions 62*c*. These greatest pressure regions Pc13 extend to the inner circumferential face 81 of the main unit casing 14, and reach (arrive at) the positions of the switchback portions 88 formed with respect to the fourth stator disc 19*d* that is the next stage.

Accordingly, in the turbomolecular pump 10 according to the present embodiment, the gas within the groove portions 62*c* is supplied to the groove portions 62*d* on the plate face 66 on the upstream side of the stator disc 19*d* that is the next stage, with no decrease in pressure due to release at the switchback portions 88 occurring, due to the presence of the wedge-shaped greatest pressure regions Pc13. Note that the pressure distribution is illustrated regarding only one groove portion 62*c* in FIG. 6A, to keep the diagram from becoming complicated. However, in the simulation results, similar pressure distributions were obtained for all other groove portions 62*c* as well.

Figure 6B:
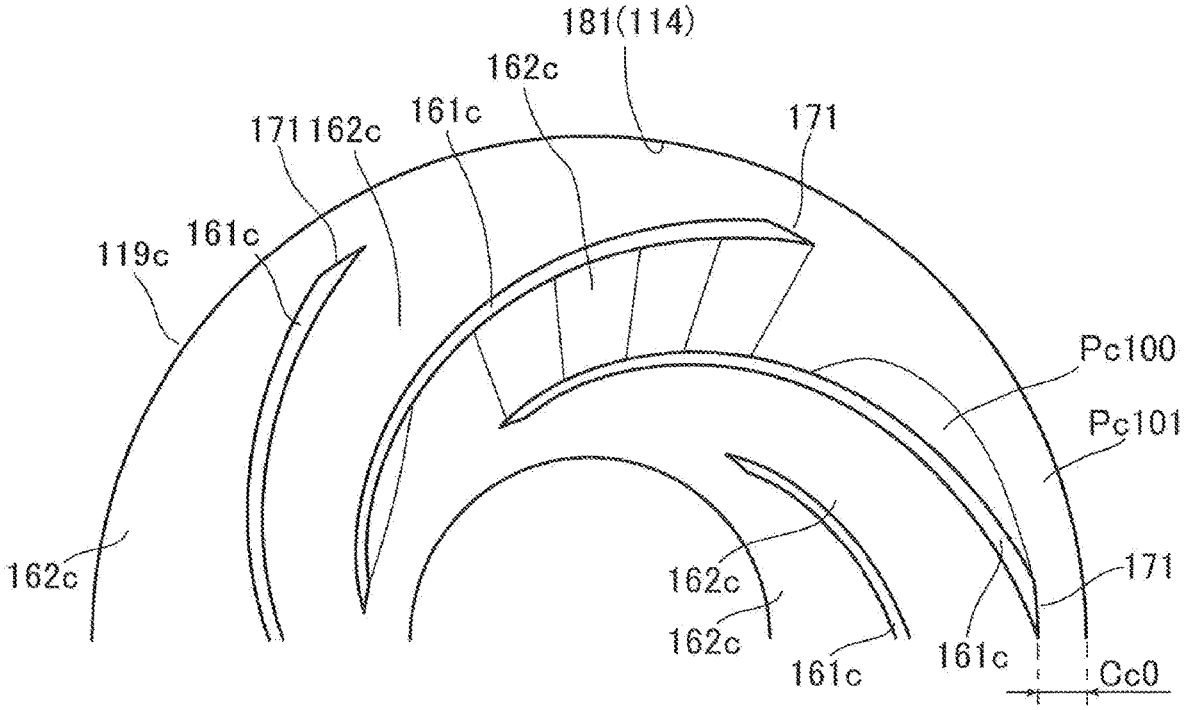
FIG. 6B is an explanatory diagram schematically illustrating part of simulation results of compression effects of a stator disc according to a conventional structure.

Conversely, FIG. 6B illustrates simulation results in a conventional structure. Also in FIG. 6B, an inner diameter of a main unit casing 114 is illustrated as being approximately the same size as the inner diameter of the main unit casing 14 in FIG. 6A.

In the conventional structure illustrated in FIG. 6B as well, gas is gradually compressed from the inner circumferential side toward the outer circumferential side. However, a clearance Cc0 between outer side end faces 171 of ridge portions 161*c* on a stator disc 119*c* and an inner circumferential face 181 of the main unit casing 114 (equivalent to a width of a channel at a switchback portion) is around 10 mm, which is five times the width Cc (e.g., 2 mm) according to the embodiment described above.

In a pressure distribution according to the conventional structure, a greatest pressure region Pc100 is manifested at a position far short of the outer side end face 171 of the ridge portion 161*c* (at a position closer to the inner circumference). The shape of this greatest pressure region Pc100 is different from that of the wedge-shaped greatest pressure region Pc13 according to the present embodiment that is illustrated in FIG. 6A. Further, a region in which pressure has decreased from the greatest pressure region Pc100 (pressure decrease region) Pc101, and which faces the inner circumferential face 181 of the main unit casing 114, occurs on the outer side of the greatest pressure region Pc100.

Accordingly, in the conventional structure, gas molecules are dissipated at downstream side end portions of the groove portions 162*c* (equivalent to end portions), and exhaust effects and compression effects are low. Note that the "advantageous kinetic momentum toward the exhaust direction" imparted to the gas at the groove portions 162*c* is more readily lost at the end portions of the groove portions 162*c* as compared to the present embodiment. Now, the "advantageous kinetic momentum toward the exhaust direction" is the kinetic momentum imparted to the gas molecules in the groove portions 162*c* so as to be advantageous in the exhaust direction (end portion direction).

According to the turbomolecular pump 10 of the present embodiment described above, the wedge-shaped greatest pressure regions Pc13 are formed at the end portions 62*c*1 (end portions on the fluid outlet guide side) of the groove portions 62*c*, on the plate face 67 on the downstream side of the stator disc 19*c*, for example. Accordingly, the pressure of the gas can be prevented from decreasing before the gas is caused to flow into the groove portions of the next stage (the groove portions 62*d* on the plate face 66 on the upstream side of the fourth stator disc 19*d* here). The gas can be effectively compressed while preventing pressure loss from occurring, and a high compression rate can be maintained.

Further, in comparison with types of vacuum pumps in which protruding portions (denoted by sign 600, etc., in Japanese Patent No. 6616560) and communicating holes (denoted by sign 501, etc., in Japanese Patent No. 6353195) are provided to raise the compression rate, such as disclosed in the aforementioned Japanese Patent Nos. 6228839, 6353195, and 6616560, there is no need for machining of the protruding portions and the communicating holes, and accordingly, high compression can be realized with correspondingly lower costs.

Further, according to the turbomolecular pump 10 of the present embodiment, the clearance Cc between the ridge portions 61*c* and the main unit casing 14 becomes even smaller depending on the situation, due to thermal expansion while operating, and in such cases compression performance increases.

The technical idea of deciding the width (clearance between the ridge portions 61*c* and the main unit casing 14) Cc of the channel at the switchback portion with the depth Hc of the channel of the Siegbahn exhaust mechanism as a reference enables a clear principle to be set forth when deciding the width Cc. This does away with the need to repeatedly go through trial and error in developing and designing the turbomolecular pump 10, thereby enabling reduction in development time and design time.

Now, formation of the wedge-shaped greatest pressure regions Pc13 such as described above can also be explained as follows. For example, in a case in which the width Cc of the channel at the switchback portion is set to around 10 mm as in the conventional structure illustrated in FIG. 6B, the width Cc becomes excessively great as compared to the clearance between the tip end faces 76 of the ridge portions 61*c* and the rotor disc 20*d* on the downstream side (e.g., not greater than 1 mm). Gas molecules readily disperse at outer circumference sides of the groove portions 62*c*, and the degree of pressure decrease at the switchback portions 88 increases.

However, by setting the width Cc of the channel at the switchback portion with the depth Hc of the channel of the Siegbahn exhaust mechanism as a reference, and making the width Cc and the depth Hc to be around the same, as in the present embodiment, an airtightness that is close to an airtightness between the groove portions 62*c* and the rotor disc 20*d* facing the downstream side can be secured at the width Cc of the channel at the switchback portion as well. As a result, the wedge-shaped pressure regions are formed at the fluid outlet guide side end portions (end portions 62*c*1) of the groove portions 62*c*, and good compression can be realized.

Also, in the present embodiment, the orientation of the rotor shaft 21 is maintained by the protective bearings 32 and 33, and accordingly the clearance Cc can be easily maintained even if the clearance Cc between the ridge portions 61*c* and the main unit casing 14 is reduced.

Also, according to the turbomolecular pump 10 of the present embodiment, ridge portions 61*c* are formed protruding from each of the plate face 66 on the upstream side of the stator disc 19*c*, and the plate face 67 on the downstream side thereof, as illustrated in FIG. 5A. Further, the ridge portions 61*c* of the plate face 66 on the upstream side (first ridge portions) and the ridge portions 61*c* of the plate face 67 on the downstream side (second ridge portions) are disposed so as to be situated on the same straight lines (straight lines S) in the thickness direction of the main unit portion 68, at end portions on the fluid outlet guide side of the groove portions 62*c* (end portions on the outer circumferential side here).

Accordingly, at the switchback portions 87 on the inner circumferential side of the third stator disc 19*c*, handover of gas compressed at the plate face 66 on the upstream side to the plate face 67 on the downstream side can be suitably performed while preventing pressure loss from occurring.

Note that the present invention is not limited to the above-described embodiment, and various modifications can be made without departing from the essence thereof. For example, description has been made here mainly regarding the third stator disc 19*c*. Various types of structures such as described above may be employed regarding the third stator disc 19*c* alone.

However, this is not limiting, and similar configurations may be employed regarding part or all of the other stator discs (the first, second, and fourth stator discs 19*a*, 19*b*, and 19*d* here). Widths (Ca, Cb, Cd (omitted from illustration)) of channels at the switchback portions may be correlated with depths (Ha, Hb, Hd (omitted from illustration)) of channels of corresponding Siegbahn exhaust mechanisms, and this relation may be the same as that of the above-described width Cc and depth Hc (at least partially the same).

Also, the structure according to the invention of the present application may be employed in only one plate face of one stator disc (e.g., the plate face 67 on the downstream side of the third stator disc 19*c*, and so forth).

Also, the relation between the width Cc of the channel at the switchback portion and the depth Hc of the channel of the Siegbahn exhaust mechanism, such as described above, may be applied to the inner circumferential side of the stator disc 19*c* as well. That is to say, the switchback portions may be formed on at least one of the outer circumferential side of the rotor disc and the inner circumferential side of the stator disc. In a case of applying the relation between the width Cc and the depth Hc to the inner circumferential side of the stator disc 19*c*, the clearance between the above-described continuous face 74 and the outer circumferential face (sign omitted) of the rotor 28 may be correlated with the height of the inner side end face 72 of the ridge portion 61*c*, and be set to around 2 mm to 3 mm, so as to be around the same (at least partially the same).

Also, narrowing of the width of the channel of such switchback portions may be performed only at the outer circumferential side (or only the inner circumferential side), or at both the outer circumferential side and the inner circumferential side.

Also, the object on which the ridge portions 61*c* and the groove portions 62*c* are formed is not limited to stator discs (stator disc 19*c* here), and may be rotor discs. Further, stator discs and rotor discs on which the ridge portions 61*c* and the groove portions 62*c* are formed may coexist. For example, the ridge portions 61*c* and the groove portions 62*c* may be formed on each of one plate face of rotor discs and one plate face of stator discs. Further, in an arrangement in which stator discs are situated above and below (upstream side and downstream side) a rotor disc interposed therebetween, the ridge portions 61*c* and the groove portions 62*c* may be provided only on the one side each of the stator discs facing the rotor disc, and so forth.

Also, the exhaust mechanism unit 15 may be a compound type made up of the turbomolecular pump mechanism unit 17 serving as a pump mechanism and a thread groove pump mechanism unit (omitted from illustration) that is a thread groove exhaust mechanism. In this case, various types of common arrangements may be employed as the thread groove pump mechanism unit (omitted from illustration).

For example, the thread groove pump mechanism unit (omitted from illustration) may include a rotor cylinder portion (omitted from illustration) and a screw thread stator (omitted from illustration). Operation may be performed in which rotation of the rotor discs 20*a* to 20*e* causes gas to be transported to the side of the thread groove pump mechanism unit (omitted from illustration), the gas is compressed at the thread groove pump mechanism unit (omitted from illustration), the compressed gas enters the outlet port 25 from the outlet portion 13, and is exhausted from the pump main unit 11 via the outlet port 25.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a first stage comprising:

a plurality of Siegbahn exhaust mechanisms in which a plurality of helical grooves are provided on both faces of an upstream side and a downstream side of a rotor disc or a stator disc, wherein an end portion of one of the plurality of helical grooves provided on the upstream side and a start portion of one of the plurality of helical grooves provided on the downstream side are situated at least partially overlapping in a circumferential direction, and a width of a first channel of a switchback portion of the upstream side and the downstream side is equivalent or less than a depth of a channel of the Siegbahn exhaust mechanisms; and a second stage comprising:

a second plurality of Siegbahn exhaust mechanisms in which a second plurality of helical grooves are provided on both faces of an upstream side and a downstream side of a second rotor disc or a second stator disc, wherein an end portion of one of the second plurality of helical grooves provided on the upstream side of the second rotor disc or second stator disc and a start portion of one of the second plurality of helical grooves provided on the downstream side of the second rotor disc or second stator disc are situated at least partially overlapping in a circumferential direction, and a width of a channel of a second switchback portion of the upstream side of the second rotor disc or second stator disc and the downstream side of the second rotor disc or second stator disc is equivalent or less than a depth of a channel of the second Siegbahn exhaust mechanisms and wherein the width of the first channel of the switchback portion is greater than the width of the channel of the second switchback portion.

2. The vacuum pump according to claim 1, wherein a side portion of the helical groove at the end portion and a side portion of the helical groove at the start portion are at least partially situated on a same straight line.

3. The vacuum pump according to claim 1, wherein the switchback portion is formed on at least one of an outer circumferential side of the rotor disc and an inner circumferential side of the stator disc.

4. The vacuum pump of claim 1 wherein the depth of the channel of the Siegbahn exhaust mechanism is greater than the depth of the channel of the second Siegbahn exhaust mechanism.

* * * * *